United States Patent [19]

Shiokawa

[11] 4,062,284

[45] Dec. 13, 1977

[54] FRICTION PRESS

[76] Inventor: Hiroyasu Shiokawa, 9-3, Sone-Nishimachi 4-Chome, Toyonaka, Osaka, Japan

[21] Appl. No.: 729,605

[22] Filed: Oct. 4, 1976

[30] Foreign Application Priority Data

Oct. 27, 1975 Japan ..... 50-129596

[51] Int. Cl.[2] ..... B30B 1/18

[52] U.S. Cl. ..... 100/289; 74/197

[58] Field of Search ..... 100/289; 425/406, 411; 74/194, 197

[56] References Cited

U.S. PATENT DOCUMENTS

| | | | |
|---|---|---|---|
| 2,770,862 | 11/1956 | Miller | 100/289 X |
| 3,418,859 | 12/1968 | Hany | 100/289 X |
| 3,418,860 | 12/1966 | Hany | 100/289 X |

FOREIGN PATENT DOCUMENTS

| | | | |
|---|---|---|---|
| 2,005,443 | 8/1971 | Germany | 74/197 |

*Primary Examiner*—Edward J. McCarthy

*Attorney, Agent, or Firm*—Wenderoth, Lind & Ponack

[57] ABSTRACT

A friction press which has a support frame and a screw bar vertically threaded through the support frame. A ram member is connected to the bottom of the screw bar and is in slidable contact with the frame. Two support arms, opposite each other with the screw rod inbetween, are fixed to the frame, and two horizontal, driving wheels are vertically spaced from each other at the top of the screw bar between the support arms. Hingedly attached to the support arms are two vertical rotatable driving disks which pivot toward and may selectively contact either the upper or lower driving wheel. The two driving disks are rotated in opposite directions by individual motors. A combination of links and levers is provided to regulate the movement of the driving disks toward and away from the respective driving wheels.

1 Claim, 5 Drawing Figures

FRICTION PRESS

BACKGROUND OF THE INVENTION

The present invention is related to a friction press having a structure characterized by a screw bar with a ram on its lower end and two driving wheels on its upper end which are vertically spaced from each other. The press further has two driving disks which turn in opposite directions on both sides of the driving wheels, and by alternately allowing the upper parts of the inner friction surfaces of the disks and the lower parts of the inner friction surfaces of the same disks to hold the friction circumference of the upper driving wheel and the lower driving wheel, the screw bar will alternately turn in one direction and then another. Consequently, the screw bar and ram will go up and down.

Conventional friction presses usually have a structure wherein one driving wheel is fixed on a screw bar which has a ram on its lower end between two driving disks provided on an identical supporting shaft on both sides of the driving wheel and which turn in the same direction. The turning of the supporting shaft of the driving disks alternates, first in one direction and then another, thus allowing the driving wheel and ram to turn and go up and down. This structure has disadvantages in that the energy of the driving disks is not conveyed to the driving wheel sufficiently because the point of contact and friction between the circumference of the driving wheel and the inner surface of the driving disk is always the same. Furthermore, at the place where the screw bar which turns and goes up and down is supported a distortion occurs at a point of contact between the circumference of the screw bar and the part to support it, thus the turning and going up and down motion of the screw bar is slowed down and the efficiency of press work decreases.

SUMMARY OF THE INVENTION

The present invention, on the other hand, provides two points of contact and friction between the circumference of the driving wheel and the inner surface of the driving disk, and moreover, enables the screw bar to be supported and turned at all times steadily in the center of the supporting part. As the result, it is possible to minimize the frictional resistance when the screw bar turns and goes up and down and to speed up the movement of the screw bar. Thus, the present invention is advantageous in respects of both improving the efficiency of press work and increasing productivity.

BRIEF DESCRIPTION OF THE DRAWINGS

The abovementioned objects and advantages of the present invention will be explained further in detail in the following with reference to the attached drawings. The invention will now be described with particular reference to the accompanying drawings, wherein.

DETAILED DESCRIPTION OF THE INVENTION

Figure 1:
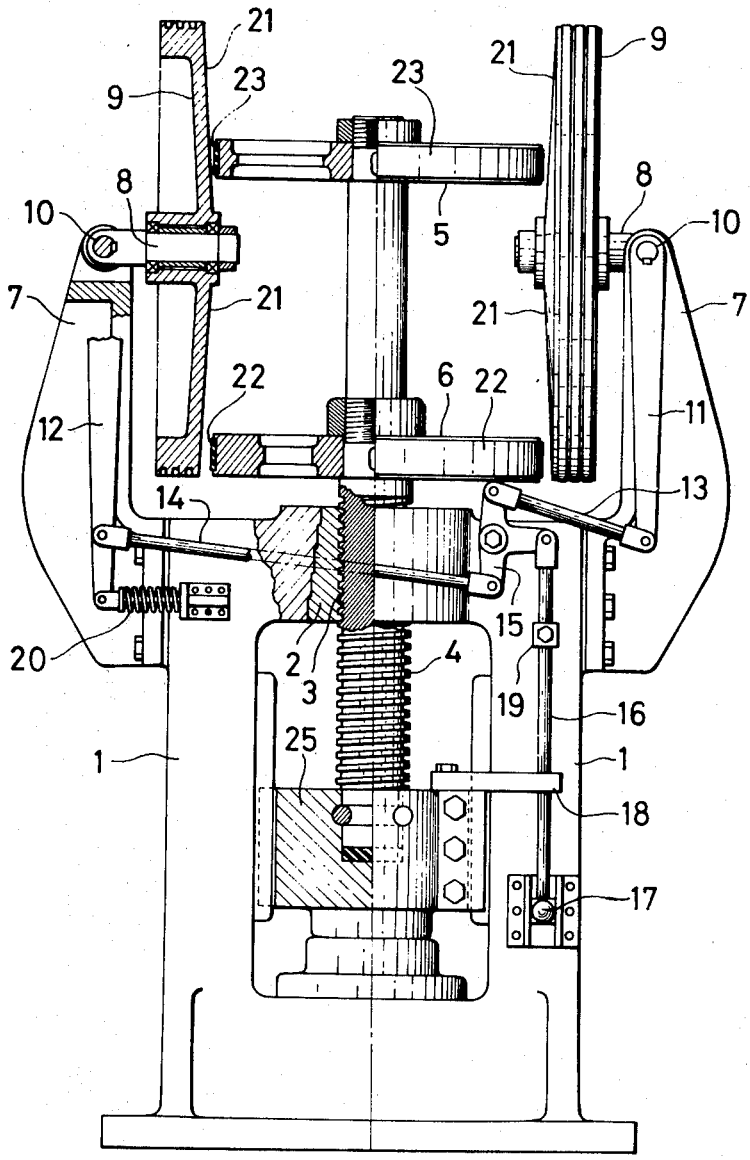
FIG. 1 is a front view of a friction press made in accordance with the present invention.
Figure 2:
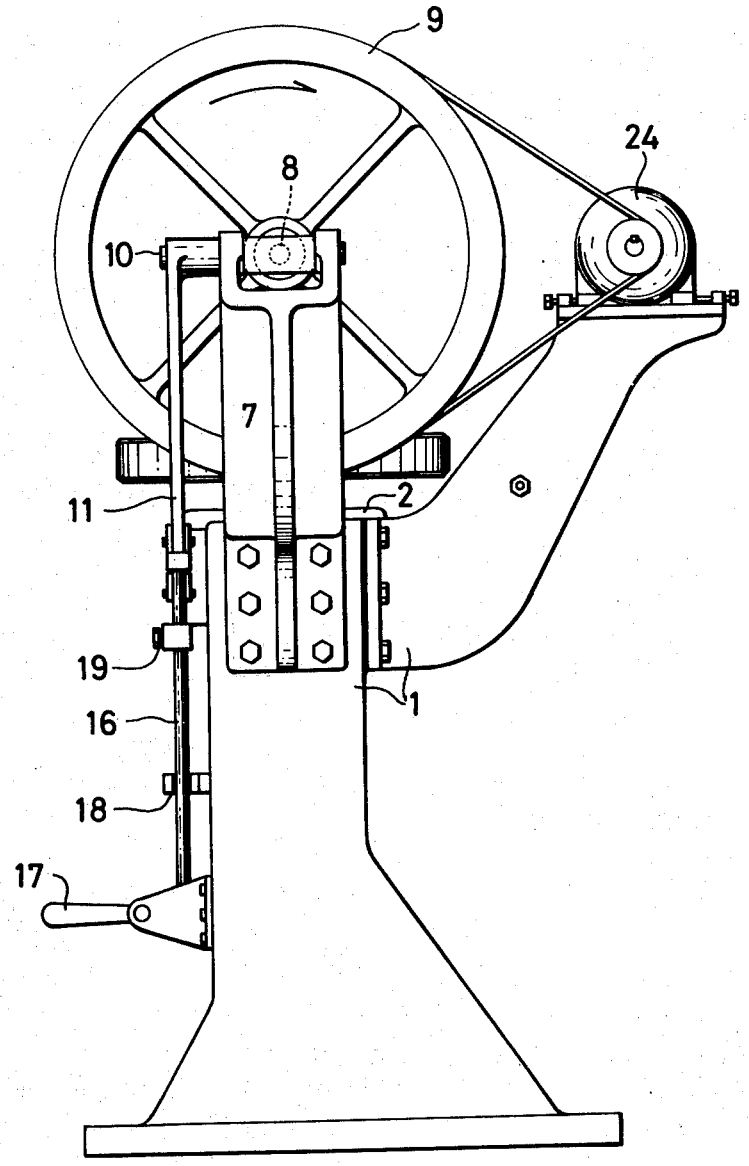
FIG. 2 is a right side view of the machine.
Figure 3:
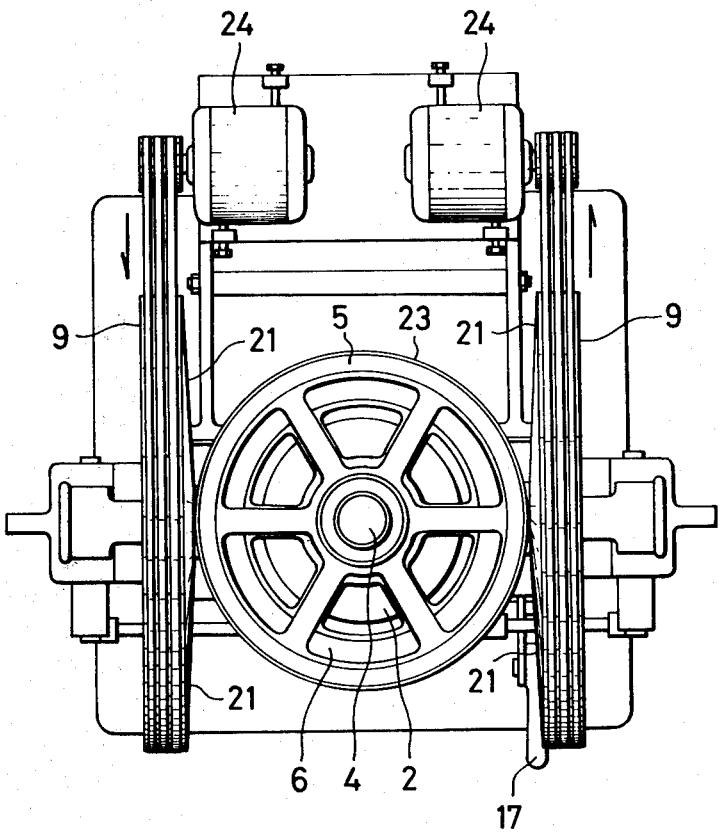
FIG. 3 is a plane view.
Figure 4:
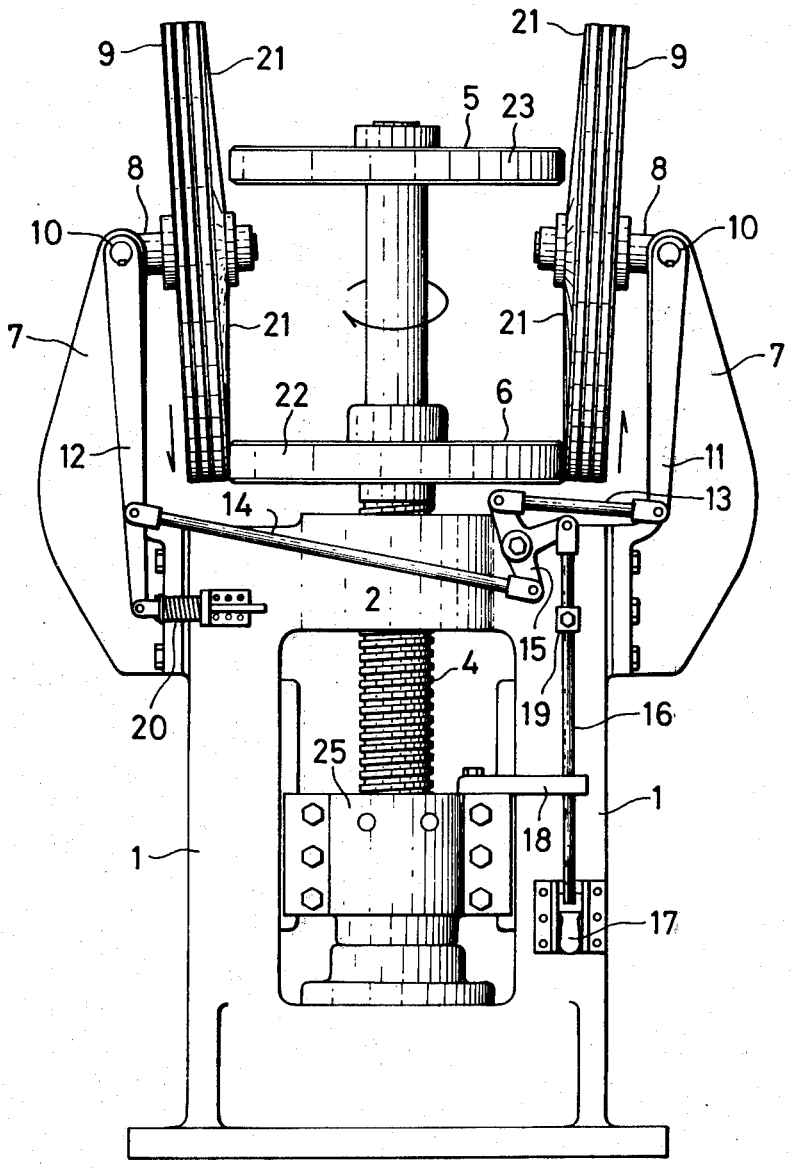
FIG. 4 is a front view of the machine to show the situation that the ram has come down.
Figure 5:
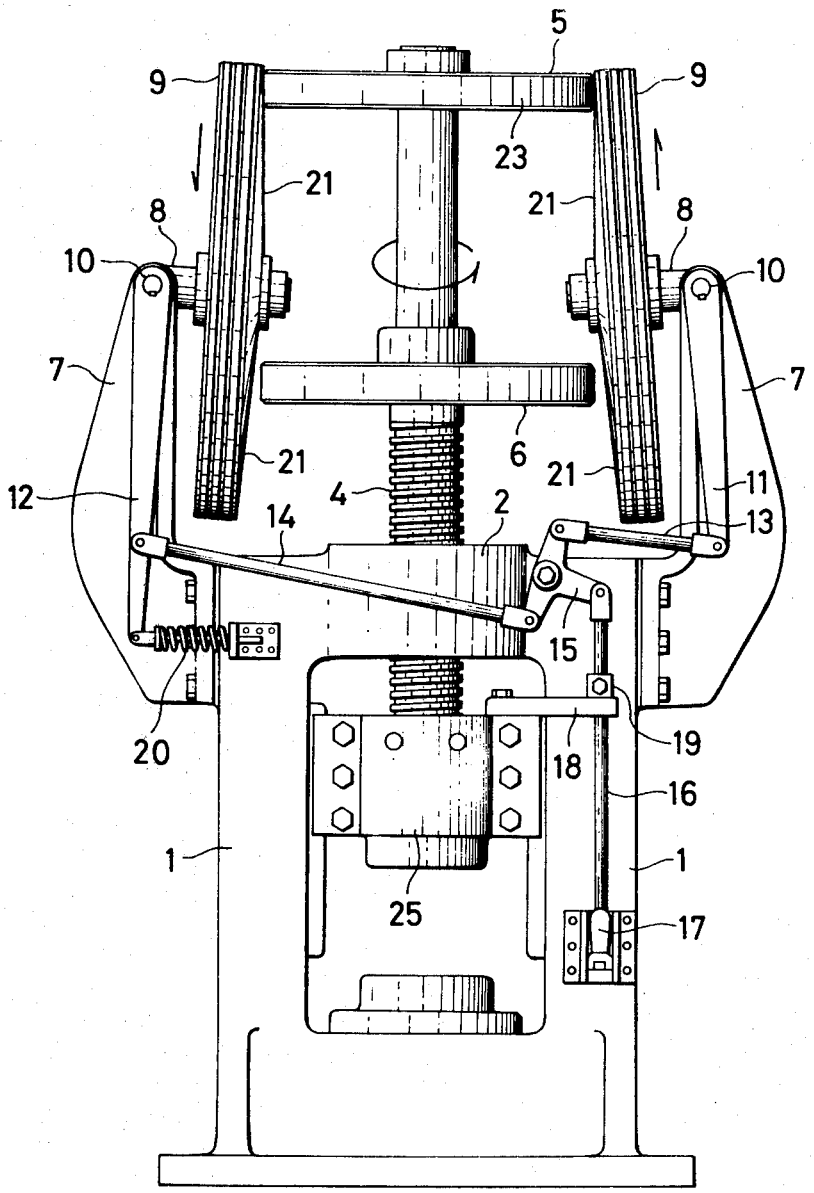
FIG. 5 is a front view of the machine to show the situation that the ram has gone up.

In FIGS. 1, 4 & 5 the motors provided in the rear of the supporting frame has been omitted.

Through an upper supporting part 2 of a frame 1, a female screw hole 3 is provided into which a screw bar 4 is screwed. On the lower end of the screw bar 4 is a loosely mounted ram 25 secured thereto. Onto the upper part of the screw 4 are two driving wheels 5 and 6 spaced an appropriate vertical interval from each other. On the top ends of supporting arms 7, 7, fixed on the upper sides of the supporting frame 1, two supporting shafts 8, 8 are hinged so as to face each other. These supporting shafts 8, 8 respectively support two driving disks 9, 9, which face each other on both sides of the driving wheels 5, 6. The driving disks 9, 9 are driven by motors 24, 24 which are provided respectively on the rear of the frame 1. Since the motors 24, 24 turn in directions opposite to each other, the turning directions of the disks 9, 9, too, are opposite to each other. The opposite ends of the suporting shafts 8, 8, respectively, are also hinged to supporting shafts 10, 10, which in turn are hingedly mounted on the top ends of the supporting arms 7, 7. The hinged supporting shafts 10, 10 are ultimately linked with an up-an-down working rod 16 through levers 11, 12, linking rods 13, 14 and a crank 15. These shafts 10, 10 allow the supporting shafts 8,8 to swing respectively through a gradient by means of operating a handle 17 provided on the lower end of said up-and-down working rod 16. By adjusting the handle 17, the upper and lower distances between the two driving disks is varied. On one side of the upper surface of the ram 25 is a stopper 18 fixed in such way that as its end touches a collar 19 (which can be fixed in an appropriate positionon the up-and-down working rod 16) and pushes the collar 19 upward, the working rod 16 also goes up. Through the crank 15 and the linking rod 14 the upward forces press a spring 20 on the lower end of the lever 12. Thus, the stopping position of the ram 25 can be adjusted by moving and fixing the collar 19 along the up-and-down working rod 16.

The actual operation of the friction press of the present invention is described below. The machine illustrated in the attached drawings has a nominal capacity of about 100 tons.

As shown in FIG. 4, when the end of the handle 17 is pushed down, the up-and-down working rod 16 goes up by leverage, thus swinging inward, respectively, since they are linked to the crank 15 and the linking rods 13, 14. The hinged supporting shafts 10, 10 mounted on th upper ends of the levers 11, 12 swing in opposite directions, and, as a result, the top ends of the supporting shafts 8, 8 are raised by leverage and hold the driving disks 9, 9 respectively in a positin such that the driving disks incline outward with their lower parts nearer to each other. Thus, the lower parts of the inner friction surfaces 21, 21 of the driving disks are held closely while turning to both sides of the friction circumference 22 of the lower driving wheel 6. In this arrangement, the screw bar 4 turns and goes downward and allows the ram 25 loosely mounted on the lower end of the screw bar 4 to do press work.

As shown in FIG. 5, when the end of the handle 17 is pulled upward, the up-and-down working rod 16 comes downward by leverage, whereby the lower parts of the levers 11, 12 swing outward respectively due to the linkage of the crank 15 annd the linking rods 13, 14.

Then, the hinged supporting shafts 10, 10 mounted on the upper ends of the levers 11, 12 swing, respectively, in opposite directions away from each other. The top ends of the supporting shafts 8, 8 lower and are held against the driving disks 9, 9 respectively in a position so that the driving disks incline inwardly and have their upper parts approach each other. Thus, the upper parts of the inner friction surfaces 21, 21 of the driving disks 9, 9 attach closely, while turning, to both sides of the friction circumference 23 of the upperdriving wheel 5. The screw bar 4 now turns and goes upward, as does the ram 25 loosely mounted on the screw bar 4. When the ram 25 goes up, the stopper 18 fixed on the upper part of the ram 25 touches the collar 29 and the levers 11, 12 are pulled inward due to their linkage with the crank 15 and the linking rods 13, 14. The driving disks 9, 9 which are holding the upper driving wheel 5 closely on both sides, are then made to return to their original positions. Accordingly, the contact between the upper driving wheel 5 and the driving disks 9, 9 is released.

In the course of the above operation, if the handle 17 is released, the ram 25 stops rising at a position balance by the expanding force of the spring 20. FIG. 5 shows the situation where the screw bar 4 has stopped rising due to the balance between the rising force of the stopper 18 and the expanding force of the spring 20. When the end of the handle is pushed downward, the screw bar 4 starts to go down again as shown in FIG. 4.

As described in the foregoing paragraphs, the present invention has two driving wheels which are fixed at a vertically appropriate interval from each other on the upper part of a screw bar which has a loosely mounted ram on its lower end. The upper and lower parts of the inner friction surfaces of two driving disks, which stand facing each other and which turn in opposite directions, hold both sides of these upper and lower driving wheels alternately and turn these wheels alternately. Thus, the present invention has the following advantages.

The point of frictional contact between the circumference of each driving wheel and the friction surface of each driving disk is achieved simultaneously in two places opposite each other on both sides of either the upper or lower driving wheels alternately. Therefore, the energy of the driving disk is conveyed to the driving wheel sufficiently and the screw bar is always kept while turning, steadily in the center of the supporting part of the machine. Accordingly, wearing of the screw bar at the time of going up or down is slight, and its frictional resistance is little. Thus, it is possible to make the turning and vertical movement of the screw bar both smooth and quick and to improve the efficiency of press work and, consequently, to increase overall productivity.

What I claim is:

1. A friction press comprising:

a support frame having a vertical threaded hole therethrough;

a screw bar member threaded through said hole;

a ram member connected to the bottom of said screw bar member and in slidable contact with said support frame;

at least two horizontal circular driving wheels vertically spaced from each other connected to the top of said screw bar;

at least two support arms connected to said support frame on opposite sides of said screw bar member;

at least two vertical rotatable driving disks, each disk hingedly connected through its horizontal transverse axis to one of said support arms at a vertical position between opposite said driving wheels and pivotable at said hinge connection alternately toward and away from contacting either of said driving wheels, said disks being rotatable in different directions;

motor means connected to said driving disks for rotating said driving disks in different directions; and linkage means mounted on said support frame and contactable with said slidable ram member for pivoting said hinged driving disks toward and away from contact with said driving wheels and for being contacted by said ram member.

* * * * *